US010287535B2

(12) United States Patent
Foster et al.

(10) Patent No.: US 10,287,535 B2
(45) Date of Patent: May 14, 2019

(54) SOLID BLOCK COMPRISING ONE OR MORE DOMAINS OF PRISMATIC OR CYLINDRICAL SHAPE AND PRODUCTION THEREOF

(71) Applicants: Ecolab USA Inc., Saint Paul, MN (US); Tobias Foster, Köln (DE); Sven Klose, Essen (DE); Dirk Kullwitz, Tönisvorst (DE); Matthew Zurbey, Cottage Grove, MN (US); Roger Stolte, Maplewood, MN (US); Mark Peterson, Prior Lake, MN (US); Irwan Yunus, St. Paul, MN (US); David Gohl, Eagan, MN (US)

(72) Inventors: Tobias Foster, Köln (DE); Sven Klose, Essen (DE); Dirk Kullwitz, Tönisvorst (DE); Matthew Zurbey, Cottage Grove, MN (US); Roger Stolte, Maplewood, MN (US); Mark Peterson, Prior Lake, MN (US); Irwan Yunus, St. Paul, MN (US); David Gohl, Eagan, MN (US)

(73) Assignee: Ecolab USA Inc., Saint Paul, MN (US)

( * ) Notice: Subject to any disclaimer, the term of this patent is extended or adjusted under 35 U.S.C. 154(b) by 63 days.

(21) Appl. No.: 15/304,156

(22) PCT Filed: Apr. 15, 2014

(86) PCT No.: PCT/EP2014/057636
§ 371 (c)(1),
(2) Date: Oct. 14, 2016

(87) PCT Pub. No.: WO2015/158369
PCT Pub. Date: Oct. 22, 2015

(65) Prior Publication Data
US 2017/0029749 A1 Feb. 2, 2017

(51) Int. Cl.
*C11D 17/00* (2006.01)
*C11D 11/00* (2006.01)

(52) U.S. Cl.
CPC ..... *C11D 17/0052* (2013.01); *C11D 11/0023* (2013.01); *C11D 11/0082* (2013.01)

(58) Field of Classification Search
CPC ..... C11D 17/00; C11D 17/0047
(Continued)

(56) References Cited

U.S. PATENT DOCUMENTS 4,569,780 A 2/1986 Fernholz et al.
5,759,974 A 6/1998 Menke et al.
(Continued)

FOREIGN PATENT DOCUMENTS

DE 19758173 A1 1/1999
DE 10 2006 029841 A1 1/2008
(Continued)

OTHER PUBLICATIONS

Ecolab USA INC. PCT/EP2014/057636 filed Apr. 15, 2014, "The International Search Report and the Written Opinion of the International Searching Authority, or the Declaration", dated Jan. 21, 2015, 8 pages.

*Primary Examiner* — Gregory E Webb
(74) *Attorney, Agent, or Firm* — McKee, Voorhees & Sease, PLC

(57) ABSTRACT

The present invention relates to a solid block comprising a solidified material, characterized in that the solid block comprises one or more domains of prismatic or cylindrical shape extending between two parallel surfaces of the solid block from one surface to the other, wherein the solidified powder inside the one or more domains and the solidified powder outside the one or more domains each comprises one or more chemical substances, and wherein the chemical
(Continued)

composition of the solidified powder inside the one or more domains is different from the chemical composition of the solidified powder outside the one or more domains. The present invention further relates to methods for producing such solid block. The present invention also relates to the use of such solid block as detergent in warewashing applications.

19 Claims, 1 Drawing Sheet

(58) Field of Classification Search
USPC ..... 510/392
See application file for complete search history.

(56) References Cited

U.S. PATENT DOCUMENTS 6,306,814 B1 10/2001 Appel et al.
2002/0004472 A1* 1/2002 Holderbaum ..... C11D 17/0078 510/290
2005/0245425 A1* 11/2005 Orlich ..... C11D 11/0088 510/444
2007/0244026 A1* 10/2007 Barthel ..... C11D 17/0073 510/445
2010/0249007 A1 9/2010 Holderbaum et al.

FOREIGN PATENT DOCUMENTS

EP 0003769 A1 9/1979
EP 0 055 100 A1 6/1982
EP 0544519 A2 6/1993
EP 1239029 A1 9/2002
WO 89/11753 A2 11/1989
WO 92/20774 A1 11/1992
WO 2008/043379 A1 4/2008

* cited by examiner

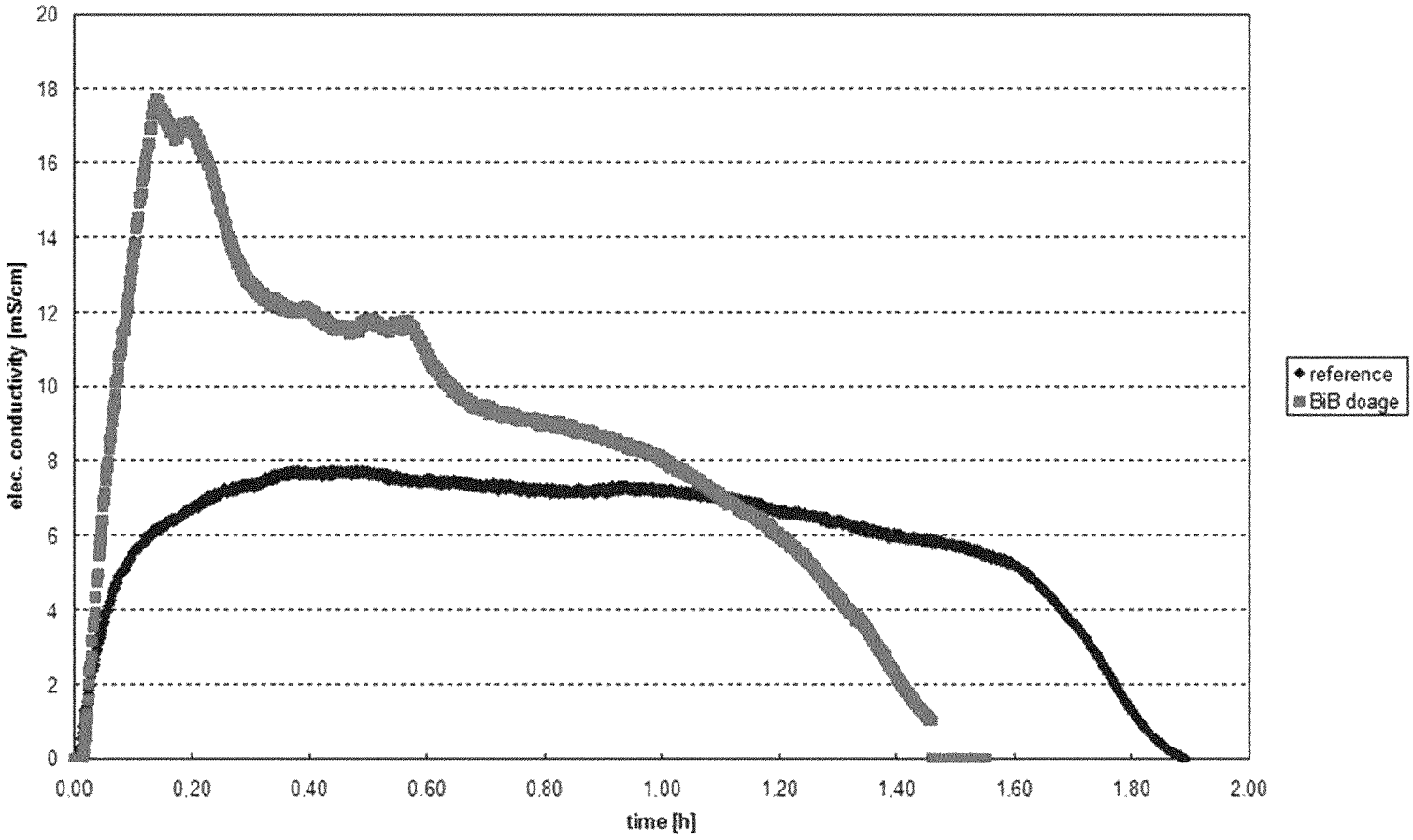
reference
BiB doage
elec. conductivity [mS/cm]
20
18
16
14
12
10
8
6
4
2
0
0.00
0.20
0.40
0.60
0.80
1.00
1.20
1.40
1.60
1.80
2.00
time [h]

SOLID BLOCK COMPRISING ONE OR MORE DOMAINS OF PRISMATIC OR CYLINDRICAL SHAPE AND PRODUCTION THEREOF

CROSS-REFERENCE TO RELATED APPLICATIONS

This is a U.S. National Phase application claiming priority to PCT/EP2014/057636 filed Apr. 15, 2014, the entire contents of which are hereby expressly incorporated by reference in its entirety including, without limitation, the specification, claims, and abstract, as well as any figures, tables, or drawings thereof.

FIELD OF THE INVENTION

The present invention relates to a solid block comprising a solidified material, characterized in that the solid block comprises one or more domains of prismatic or cylindrical shape extending between two parallel surfaces of the solid block from one surface to the other, wherein the solidified powder inside the one or more domains and the solidified powder outside the one or more domains each comprises one or more chemical substances, and wherein the chemical composition of the solidified powder inside the one or more domains is different from the chemical composition of the solidified powder outside the one or more domains. The present invention further relates to methods for producing such solid block. The present invention also relates to the use of such solid block as detergent in warewashing applications.

DESCRIPTION OF THE PRIOR ART

In conventional warewashing detergent compositions, a peroxide source is often used in combination with a peroxidation catalyst. One option to apply the combination of a catalyst and a peroxide source to the dishwasher is to include both components into a solid detergent. Thereby, a solid catalyst is blended together with a solid peroxide source like e. g. sodium percarbonate. The problem with this approach is, however, the intrinsic incompatibility of both components due to their high mutual reactivity. WO99/06522, WO99/27063 and WO99/27067 describe block detergents for domestic applications with different phases, each phase comprising different components. For industrial applications, however, where a single solid block is sprayed with water from one side over a time period of several washing cycles these block detergents are unsuitable since the different phases would not dissolve simultaneously.

It is, therefore, an object of the present invention to provide an improved solid block for warewashing applications which allows bringing incompatible components together. It is a further object of the present invention to provide an improved solid block for warewashing applications, which allows for simultaneous dissolution of the different components when applied in a warewashing machine.

SUMMARY OF THE INVENTION

It has now surprisingly been found that incompatible components can be brought together in a solid block detergent composition and that these components may simultaneously dissolve if the solid block comprises one or more domains of prismatic or cylindrical shape extending between two parallel surfaces of the solid block from one surface to the other.

Therefore, in a first aspect, the present invention is directed to a solid block comprising a solidified material, characterized in that the solid block comprises one or more domains of prismatic or cylindrical shape extending between two parallel surfaces of the solid block from one surface to the other, wherein the solidified powder inside the one or more domains and the solidified powder outside the one or more domains each comprises one or more chemical substances, and wherein the chemical composition for the solidified powder inside the one or more domains is different from the chemical composition of the solidified powder outside the one or more domains.

In a further aspect, the present invention is directed to methods for producing the solid block as described above, the method comprising the following steps:

a. providing a powder comprising one or more chemical substances,
b. filling the powder in a mold having prismatic or cylindrical shape,
c. solidifying the powder to a solid block of prismatic or cylindrical shape,
d. optionally repeating steps a. to c.,
e. placing one or more solid blocks of prismatic or cylindrical shape in a mold of larger volume than the volume of the one or more solid blocks of prismatic or cylindrical shape,
f. filling the free volume of the mold with a powder comprising one or more chemical substances, the powder having a different chemical composition from the powder of step a.,
g. solidifying the powder of step f. to obtain a solid block.

In yet another aspect, the present invention is directed to a method for producing a solid block as described above, the method comprising the following steps:

a. providing a powder comprising one or more chemical substances,
b. melting the powder,
c. filling the melted powder in a mold having one or more inserts of prismatic or cylindrical shape,
d. solidifying the melted powder,
e. removing the one or more inserts to leave one or more holes,
f. providing a powder comprising one or more chemical substances, the powder having a different chemical composition from the powder of step a.,
g. melting the powder,
h. optionally repeating steps f. to g.,
i. filling the melted powder in the one or more holes,
j. solidifying the melted powder in the one or more holes to obtain a solid block.

In even a further aspect, the present invention is directed to a method for producing a solid block as described above, the method comprising the following steps:

a. providing a powder comprising one or more chemical substances,
b. melting the powder
c. filling the melted powder in a mold,
d. solidifying the melted powder,
e. drilling one or more holes of prismatic or cylindrical shape into the melted powder,
f. providing a powder comprising one or more chemical substances, the powder having a different chemical composition from the powder of step a.,
g. melting the powder, h. optionally repeating steps f. to g., i. filling the melted powder in the one or more holes, j. solidifying the melted powder in the one or more holes to obtain a solid block.

In another aspect, the present invention is directed to the use of a solid block as described above as detergent in warewashing applications.

DESCRIPTION OF THE FIGURES

FIG. 1 shows the dosage behavior of a solid block according to the invention (BIB dosage) and the respective reference without inner domains, as monitored by the time-dependent electric conductivity.

DETAILED DESCRIPTION OF THE INVENTION

The present invention is, in a first aspect, directed to a solid block comprising a solidified material, characterized in that the solid block comprises one or more domains of prismatic or cylindrical shape extending between two parallel surfaces of the solid block from one surface to the other, wherein the solidified powder inside the one or more domains and the solidified powder outside the one or more domains each comprises one or more chemical substances, and wherein the chemical composition for the solidified powder inside the one or more domains is different from the chemical composition of the solidified powder outside the two or more domains.

The solid block according to the present invention reduces the contact area of the two potentially incompatible components to the macroscopic contact area between the one or more domains. Thus, any unfavourable reactions of the two potentially incompatible components are reduced to this macroscopic contact area, instead of occurring within the entire volume of a homogenously blended block of two well-mixed components. Further, due to the prismatic or cylindrical shape of the one or more domains extending between two parallel surfaces of the solid block from one surface to the other, the single components inside and outside the domains may dissolve at comparable rate when the block is sprayed with water specifically from one of the two parallel surfaces in an industrial warewashing machine.

According to the present invention it is preferred that the solidified powder inside the one or more domains and the solidified powder outside the one or more domains dissolves at nearly equal rate. Accordingly, in a further aspect, the present invention relates to a solid block as described above, characterized in that the solubility in water at 25° C. of the solidified powder inside the one or more domains and the solubility in water at 25° C. of the solidified powder outside the one or more domains differ by not more than 10%, preferably by not more than 4% and most preferably by not more than 1 or 2%.

The present invention can, of course, be generalised to the use of more than one domain of prismatic or cylindrical shape, i.e. two, three or even more such domains of prismatic or cylindrical shape can be included in the solid block, each domain extending between two parallel surfaces of the solid block from one surface to the other.

There is no restriction as to how the powder in the solid block is solidified. According to the present invention it is possible that the powder may be solidified or may be melt and later on congealed. Accordingly, in a further aspect, the present invention relates to a solid block as described above, characterized in that the solidified powder inside the one and more domains and/or outside the one or more domains is a solidified powder or a congealed melt.

According to the present invention the solidified powder inside the one or more domains and the solidified powder outside the one or more domains do not necessarily need to be incompatible. It may be preferred that the solidified powder inside the one or more domains and/or the solidified powder outside the one or more domains may comprise one or more chemical substances selected from the group consisting of peroxides, peroxidation catalysts, surfactants, chelating/sequestering agents, detergent fillers or binding agents, alkalinity sources, enzymes, activating agents, deforming agents, anti-redeposition agents, dyes, odorants, bleaching agents, polymers, deliming agents, stabilizing agents, soil, suspending agents, antimicrobial agents, and water.

However, it may also be preferred that the solidified powder inside the one or more domains and/or the solidified powder outside the one or more domains is free of, i.e. does not comprise, one or more chemical substances selected from the group consisting of peroxides, peroxidation catalysts, surfactants, chelating/sequestering agents, detergent fillers or binding agents, alkalinity sources, enzymes, activating agents, defoaming agents, anti-redeposition agents, dyes, odorants, bleaching agents and water.

Accordingly, in a further aspect, the present invention is directed to a solid block as described above, characterized in that the solidified powder inside the one or more domains and/or the solidified powder outside the one or more domains comprises one or more chemical substances selected from the group consisting of peroxides, peroxidation catalysts, surfactants, chelating/sequestering agents, detergent fillers or binding agents, alkalinity sources, enzymes, activating agents, deforming agents, anti-redeposition agents, dyes, odorants, bleaching agents and water.

In yet a further aspect, the present invention is directed to a solid block as described above, characterized in that the solidified powder inside the one or more domains and/or the solidified powder outside the one or more domains is free of, i.e. does not comprise, one or more chemical substances selected from the group consisting of peroxides, peroxidation catalysts, surfactants, chelating/sequestering agents, detergent fillers or binding agents, alkalinity sources, enzymes, activating agents, defoaming agents, anti-redeposition agents, dyes, odorants, bleaching agents and water.

The present invention also relates to a solid block comprising a solidified powder, characterized in that the solid block comprises one or more domains of prismatic or cylindrical shape extending between two parallel surfaces of the solid block from one surface to the other, wherein the solidified powder inside the one or more domains and the solidified powder outside the one or more domains each comprises one or more chemical substances, and wherein the chemical composition of the solidified powder inside the one or more domains is different from the chemical composition of the solidified powder outside the one or more domains.

According to the present invention, the solidified powder inside the one or more domains and/or the solidified powder outside the one or more domains may comprise a peroxidation catalyst. A suitable peroxidation catalyst is a peroxidation catalyst according to formula (I):

$$[(L_pM_q)_nX_r]Y_s \quad \text{(I)}$$

Wherein each L independently is an organic ligand containing at least three nitrogen atoms and/or at least two carboxyl groups that coordinate with the metal M;

M is Mn or Fe;

each X independently is a coordinating or bridging group selected from the group consisting of $H_2O$, $OH^-$, $SH^-$, $HO_2^-$, $O^{2-}$, $O_2^{2-}$, $S^{2-}$, $F^-$, $Cl^-$, $Br^-$, $I^-$, $NO_3^-$, $NO_2^-$, $SO_4^{2-}$, $SO_3^{2-}$, $PO_4^{3-}$, $N_3^-$, $CN^-$, $NR_3$, $NCS^-$, RCN, $RS^-$, $RCO_2^-$, $RO^-$, and

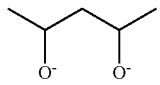

with R being hydrogen or a $C_1$ to $C_6$ alkyl group;

p is an integer from 1 to 4;

q is an integer from 1 to 2;

r is an integer from 0 to 6;

Y is a counter ion;

and s is the number of counter ions.

While it is known to use Mn and Fe as peroxidation catalysts, providing the metal in the form of a complex according to formula (I) has several advantages such as increasing the activity and the stability of the complex. In particular in the case of Mn complexes, the ligands L help to increase the solubility of the metal.

In a particularly preferred example the peroxidation catalyst is a binuclear complex according to formula (II)

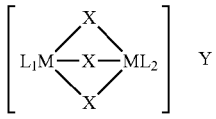

wherein $L_1$ and $L_2$ can either be separate ligands or where $L_1$ and $L_2$ can combine to be a single molecule.

Among the coordinating or bridging groups, the groups $O^{2-}$, $O_2^{2-}$, $CH_3O$—, $CH_3CO^{2-}$,

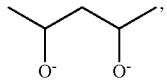

or Cl— are particularly preferred.

Preferably, the ligands are selected from the group consisting triazacyclononane, triazacyclononane derivatives, Schiff-base containing ligands, polypyridineamine ligands, pentadentate nitrogen-donor ligands, bispidon-type ligands, and macrocyclic tetraamidate ligands. Examples for those classes of ligands are described by R. Hage and A Lienke (Hage, Ronald; Lienke, Achim; Applications of Transition-Metal Catalysts to Textile and Wood-Pulp Bleaching; Angewandte Chemie International Edition, 2005, 45. Jg., Nr. 2, pp. 206-222).

Another group of preferred ligands are dicarboxylates, in particular oxalate.

Particularly preferred ligands are the compounds according to formulae (II) to (IV)

(II)

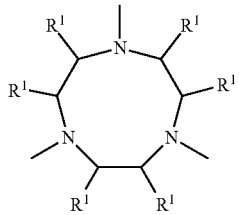

(III)

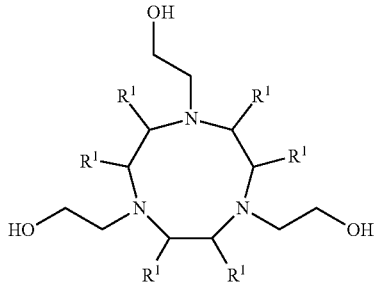

(IV)

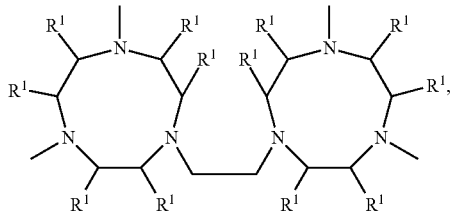

wherein each $R^1$ independently is hydrogen or a $C_1$ to $C_6$ alkyl group.

Other suitable ligands are the compounds according to formulae (V) to (XVIII)

(V)

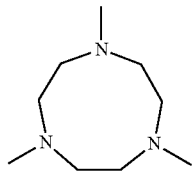

(VI)

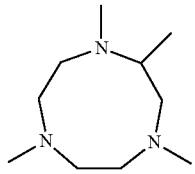

(VII)

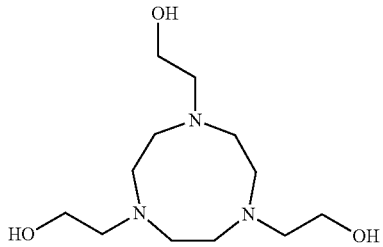

-continued
(VIII)
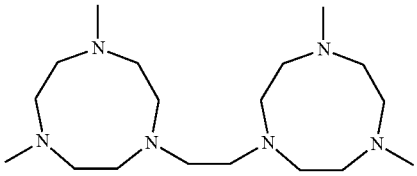
(IX)
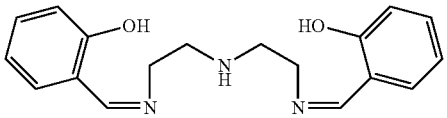
(X)
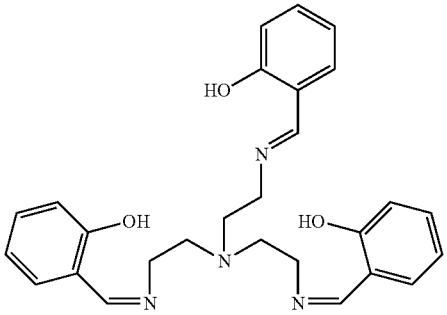
(XI)
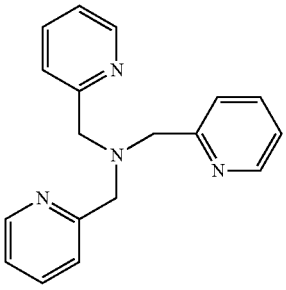
(XII)
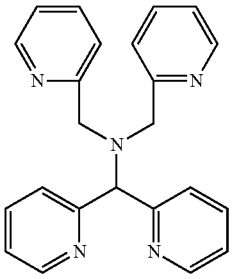
(XIII)
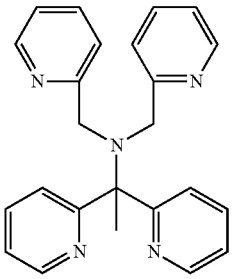
-continued
(XIV)
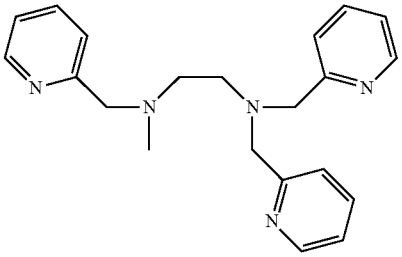
(XV)
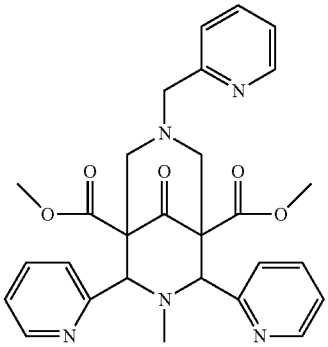
(XVI)
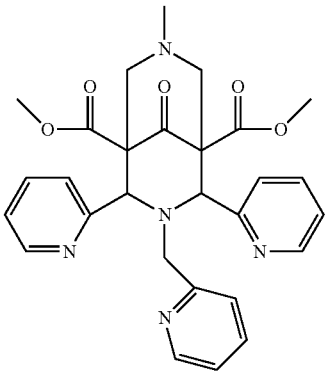
(XVII)
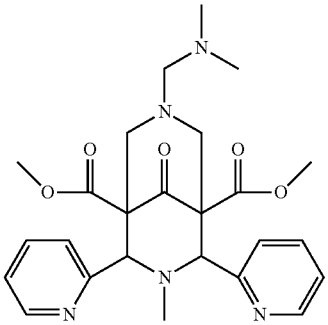
(XVIII)
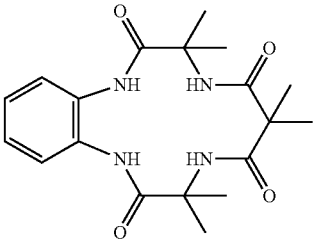

The ligands (V) to (X) are particularly suited if the metal M is Mn. The ligands (XII) to (XVIII) are particularly well-suited if the metal M is Fe. Ligand (XI) is equally suited for Mn and Fe.

The counter ion Y is selected depending on the charge of the complex $[(L_pM_q)_nX_r]$. The number of counter ions s is equal to the number of counter ions required to achieve charge neutrality. Preferably the number of counter ions s is 1 to 3. The type of counter ion Y for charge neutrality is not critical for the activity of the complex and can be selected from, for example, the group consisting of $Cl^-$, $Br^-$, $I^-$, $NO_3^-$, $ClO_4^-$, $NCS^-$, $BPh_4^-$, $BF_4^-$, $PF_6^-$, $R^2—SO_3^-$, $R^2—SO_4^-$, and $R^2—CO_2^-$, wherein $R^2$ is hydrogen or a $C_1$ to $C_4$ alkyl group. Particularly preferred counter ions are $PF_6^-$ and $ClO_4^-$.

In an especially preferred embodiment, the peroxidation catalyst is a complex according to formula (II), wherein M is manganese, X is selected from the group consisting of $O^{2-}$, $O_2^{2-}$, $CH_3O—$, $CH_3CO^{2-}$,

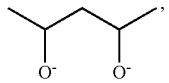

or Cl—, and the ligand L is a compound according to formulae (II) and/or (IV).

A peroxidation catalyst, wherein M is manganese and L is oxalate, is also preferred.

Particularly preferred peroxidation catalysts are the compounds according to formulae (XIX) and (XX), also referred to as MnTACN and MnDTNE, respectively.

(XIX)

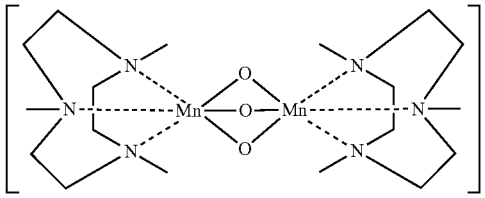

$[PF_6]_2$ (XX)

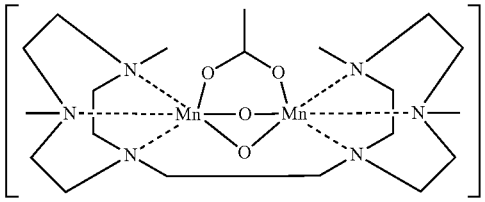

$(Cl)_2$

The solidified powder inside the one or more domains and/or the solidified powder outside the one or more domains may comprise one or more peroxides. A preferred peroxide source is an alkali metal percarbonate. It has surprisingly been found that alkali metal percarbonate, when combined with alkali metal carbonate and the peroxidation catalyst of formula (I) mentioned above efficiently removes starch soil from dishes even at a mildly alkaline pH and a temperature of 50 to 65° C.

According to the present invention, the solidified inside the one or more domains and/or the solidified powder outside the one or more domains may comprise one or more surfactants.

A variety of surfactants can be used in the present composition, such as anionic, nonionic, cationic, and zwitterionic surfactants. Suitable anionic surfactants are, for example, carboxylates such as alkylcarboxylates (carboxylic acid salts) and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, alkylether sulfates; and phosphate esters such as alkylphosphate esters. Exemplary anionic surfactants include sodium alkylarylsulfonate, alpha-olefinsulfonate, and fatty alcohol sulfates.

Suitable nonionic surfactants are, for example, those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark Pluronic (BASF), and other like nonionic compounds. Silicone surfactants can also be used.

Suitable cationic surfactants include, for example, amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, 2-alkyl-1-(2-hydroxyethyl)-2-imidazoline; and quaternary ammonium salts, as for example, alkylquarternary ammonium chloride surfactants such as n-alkyl($C_{12}$-$C_{18}$)dimethylbenzyl ammonium chloride, n-tetradecyldimethylbenzylammonium chloride monohydrate, naphthylene-substituted quaternary ammonium chloride such as dimethyl-1-naphthylmethylammonium chloride. The cationic surfactant can be used to provide sanitizing properties.

Suitable zwitterionic surfactants include, for example, betaines, imidazolines, and propinates.

If the solid block according to the present invention is intended to be used in an automatic dishwashing or warewashing machine, the surfactants selected, if any surfactant is used, can be those that provide an acceptable level of foaming when used inside a dishwashing or warewashing machine. It should be understood that warewashing compositions for use in automatic dishwashing or warewashing machines are generally considered to be low-foaming compositions.

According to the present invention, the solidified powder inside the one or more domains and/or the solidified powder outside the one or more domains may comprise an activating agent to further increase the activity of the percarbonate. Such an activating agent is used in addition to the peroxidation catalyst. Suitable activating agents include sodium-4-benzoyloxy benzene sulphonate (SBOBS); N,N,N',N'-tetraacetyl ethylene diamine (TAED); sodium-1-methyl-2-benzoyloxy benzene-4-sulphonate; sodium-4-methyl-3-benzoyloxy benzoate; SPCC trimethyl ammonium toluyloxy benzene sulphonate; sodium nonanoyloxybenzene sulphonate, sodium 3,5,5-trimethyl hexanoyloxybenzene sulphonate; penta acetyl glucose (PAG); octanoyl tetra acetyl glucose and benzoyl tetracetyl glucose.

According to the present invention the solidified powder inside the one or more domains and/or the solidified powder outside the one or more domains may comprise one or more chelating/sequestering agents. Suitable chelating/sequestering agents are, for example, citrate, aminocarboxylic acid, condensed phosphate, phosphonate, and polyacrylate. In general, a chelating agent is a molecule capable of coordinating (i.e., binding) the metal ions commonly found in natural water to prevent the metal ions from interfering with the action of the other detersive ingredients of a cleaning composition. In general, chelating/sequestering agents can generally be referred to as a type of builder.

Suitable aminocarboxylic acids include, for example, methylglycinediacetic acid (MGDA), N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA).

Examples of condensed phosphates include sodium and potassium orthophosphate, sodium and potassium pyrophosphate, sodium tripolyphosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$(HEDP); amino tri(methylenephosphonic acid) $N[CH_2PO(OH)_2]_3$; aminotri(methylenephosphonate), sodium salt $(NaO)(HO)P(OCH_2N[CH_2PO(ONa)_2]_2)$; 2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene) triamine(pentamethylenephosphonic acid) $(HO_2)POCH_2N[(CH_2)_6N[CH_2PO(OH)_2]_2]_2$; and phosphorus acid $H_3PO_3$.

Preferred phosphonates are 1-Hydroxy Ethylidene-1,1-Diphosphonic Acid (HEDP), aminotris(methylenephosphonic acid) (ATMP) and Diethylenetriamine penta(methylene phosphonic acid) (DTPMP).

A neutralized or alkaline phosphonate, or a combination of the phosphonate with an alkali source prior to being added into the mixture such that there is little or no heat or gas generated by a neutralization reaction when the phosphonate is added is preferred. The phosphonate can comprise a potassium salt of an organo phosphonic acid (a potassium phosphonate). The potassium salt of the phosphonic acid material can be formed by neutralizing the phosphonic acid with an aqueous potassium hydroxide solution during the manufacture of the solid detergent. The phosphonic acid sequestering agent can be combined with a potassium hydroxide solution at appropriate proportions to provide a stoichiometric amount of potassium hydroxide to neutralize the phosphonic acid. A potassium hydroxide having a concentration of from about 1 to about 50 wt % can be used. The phosphonic acid can be dissolved or suspended in an aqueous medium and the potassium hydroxide can then be added to the phosphonic acid for neutralization purposes.

The chelating/sequestering agent may also be a water conditioning polymer that can be used as a form of builder. Exemplary water conditioning polymers include polycarboxylates. Exemplary polycarboxylates that can be used as water conditioning polymers include polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers.

Silicates may be included in the solidified powder inside the one or more domains and/or the solidified powder outside the one or more domains as well. Silicates soften water by the formation of precipitates that can be easily rinsed away. They commonly have wetting and emulsifying properties, and act as buffering agents against acidic compounds, such as acidic soil. Further, silicates can inhibit the corrosion of stainless steel and aluminum by synthetic detergents and complex phosphates. A particularly well suited silicate is sodium metasilicate, which can be anhydrous or hydrated.

According to the present invention, the solidified powder inside the one or more domains and/or the solidified powder outside the one or more domains may comprise one or more detergent fillers or binding agents. Examples of detergent fillers or binding agents suitable for use in the solidified powder in the solid block according to the invention include sodium sulphate, sodium chloride, starch, sugars and $C_1$-$C_{10}$-alkylene glycols such as propylene glycol.

The solidified powder inside the one or more domains and/or the solidified powder outside the one or more domains may comprise one or more alkalinity sources. According to the present invention, it is preferred that the solidified powder inside the one or more domains and/or the solidified powder outside the one or more domains comprises an alkali metal carbonate as source of alkalinity. According to the present invention, it is further preferred that the solidified powder inside the one or more domains and/or the solidified powder outside the one or more domains comprises an effective amount of alkali metal carbonate. In the context of the present invention, an effective amount of the alkali metal carbonate is an amount that provides a use solution having a pH of at least 8, preferably a pH of 9.5 to 11, more preferably 10 to 10.3. A use solution in the context of the present invention is considered a solution of 1 g/l of the solid block in distilled water. The pH of the use solution is meant to be determined at room temperature.

According to the present invention it may further be preferred that the solid block provides a pH measured at room temperature of at least 8, preferably a pH of 9.5 to 11, more preferably of 10 to 11 when diluted in distilled water at a concentration of 1 g/l.

Suitable alkali metal carbonates are, e. g., sodium or potassium carbonate, sodium or potassium bicarbonate, sodium or potassium sesquicarbonate and mixtures thereof.

Due to the use of an alkali metal carbonate as alkalinity source, other alkalinity sources such as alkali metal hydroxides are usually not required. Preferably, the solidified powder inside the one or more domains and/or the solidified powder outside the one or more domains does not comprise alkali metal hydroxides.

According to the present invention the solidified powder inside the one or more domains and/or the solidified powder outside the one or more domains may comprise one or more enzymes. The solidified powder inside the one or more domains and/or the solidified powder outside the one or more domains may include enzymes that provide desirable activity for removal of protein-based, carbohydrate-based, or triglyceride-based soil. Although not limiting to the present invention, enzymes suitable for the cleaning composition can act by degrading or altering one or more types of soil residues encountered on crockery thus removing the soil or making the soil more removable by a surfactant or other component of the cleaning composition. Suitable enzymes include a protease, an amylase, a lipase, a gluconase, a cellulase, a peroxidase, or a mixture thereof of any suitable origin, such as vegetable, animal, bacterial, fungal or yeast origin.

According to the present invention, the solidified powder inside the one or more domains and/or the solidified powder outside the one or more domains may comprise one or more defoaming agents. Suitable defoaming agents include, for example, ethylene oxide/propylene block copolymers such as those available under the name Pluronic N-3, silicone compounds such as silica dispersed in polydimethylsiloxane, polydimethylsiloxane, and functionalized polydimethylsiloxane, fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate.

According to the present invention, the solidified powder inside the one or more domains and/or the solidified powder outside the one or more domains may comprise one or more anti-redeposition agents. Examples of suitable anti-redeposition agents include fatty acid amides, fluorocarbon surfactants, complex phosphate esters, styrene maleic anhydride copolymers, and cellolosic derivatives such as hydroxyl ethyl cellulose, hydroxyl propyl cellulose, and the like.

According to the present invention, various dyes, odorants including perfumes and other aesthetic enhancing agents can be included in the solidified powder inside the one or more domains and/or the solidified powder outside the one or more domains. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), and Acid Green 25 (Ciba-Geigy).

Fragrances or perfumes that may be incorporated in the compositions include, for example, terpenoids such as citronellol, aldehydes such as amyl cinnamaldehyde, a jasmine such as C1S-jasmine or jasmal, and vanillin.

According to the present invention it may be preferred that the one or more domains make up between 10% and 50%, preferably between 25% and 35%, of the volume of the solid block.

Accordingly, in a further aspect, the present invention is directed to a solid block as described above, characterized in that the one or more domains make up between 10% and 50%, preferably between 25% and 35%, of the volume of the solid block.

According to the present invention it may also be preferred that the perimeter of the solid block measured between two parallel surfaces is between 0.2 to 0.5 m, preferably 0.2 to 0.4 m and most preferably 0.3 m.

Accordingly, in a further aspect, the present invention is directed to a solid block as described above, characterized in that the perimeter of the solid block measured between two parallel surfaces is between 0.2 to 0.5 m, preferably 0.2 to 0.4 m and most preferably 0.3 m.

According to the present invention it may also be preferred that the weight of the solid block is more than 0.5 kg, preferably more than 1 kg.

Accordingly, in a preferred aspect, the present invention is directed to a solid block as described above, characterized in that the weight of the solid block is more than 0.5 kg, preferably more than 1 kg.

In a further aspect, the present invention is directed to a method for producing the solid block as described above, the method comprising the following steps:

a. providing a powder comprising one or more chemical substances,
b. filling the powder in a mold having prismatic or cylindrical shape,
c. solidifying the powder to a solid block of prismatic or cylindrical shape,
d. optionally repeating steps a. to c.,
e. placing one or more solid blocks of prismatic or cylindrical shape in a mold of larger volume than the volume of the one or more solid blocks of prismatic or cylindrical shape,
f. filling the free volume of the mold with a powder comprising one or more chemical substances, the powder having a different chemical composition from the powder of step a.,
g. solidifying the powder of step f. to obtain a solid block.

In yet another aspect, the present invention is directed to a method for producing a solid block as described above, the method comprising the following steps:

a. providing a powder comprising one or more chemical substances,
b. melting the powder,
c. filling the melted powder in a mold having one or more inserts of prismatic or cylindrical shape,
d. solidifying the melted powder,
e. removing the one or more inserts to leave one or more holes,
f. providing a powder comprising one or more chemical substances, the powder having a different chemical composition from the powder of step a.,
g. melting the powder,
h. optionally repeating steps f. to g.,
i. filling the melted powder in the one or more holes,
j. solidifying the melted powder in the one or more holes to obtain a solid block.

In even a further aspect, the present invention is directed to a method for producing a solid block as described above, the method comprising the following steps:

a. providing a powder comprising one or more chemical substances,
b. melting the powder
c. filling the melted powder in a mold,
d. solidifying the melted powder,
e. drilling one or more holes of prismatic or cylindrical shape into the melted powder,
f. providing a powder comprising one or more chemical substances, the powder having a different chemical composition from the powder of step a.,
g. melting the powder,
h. optionally repeating steps f. to g.,
i. filling the melted powder in the one or more holes,
j. solidifying the melted powder in the one or more holes to obtain a solid block.

The solid block according to the present invention may be used as detergent in warewashing applications, where the solid block is inserted in industrial warewashing machines. Accordingly, in a further aspect, the present invention is directed to the use of a solid block described above as detergent in warewashing applications, preferably characterized in that the solid block is inserted in industrial warewashing machines.

The present invention will be further illustrated by the following example.

Example 1

This is an example of a block made of a solid cleaning composition based on ash (typical compositions can contain 50-70 wt. % carbonate salt, 1-10 wt. % sequestrant, 1-10 wt. % builder, 1-10 wt. % surfactant, 1-10 wt. % secondary alkalinity source, 1-10 wt. % water; typical compositions can include as sequestrants DTPA, HEDP, NTA, or the like; as builder citric acid, sodium polyacrylate, tripolyphosphate, or the like; as secondary alkalinity source sodium metasilicate, hydroxide salt, or the like). In this block, three holes were drilled using a commercially available drill. These holes were afterwards filled with a heated (70° C.) slurry formed by mixing 200 g sodium hydroxide beads with 98 g sodium hydroxide solution (50 wt. %) and 2 g black dye (Luconyl Black 0060 solution, BASF, 0.2 wt. % in water); before filled into the holes, the resulting mixture was stirred at elevated temperature (70° C.) until the homogeneous slurry was formed. The dosage behavior of the resulting block prototype was compared with the dosage behavior of a non-modified block of the same solid cleaning composition. The corresponding dosage tests were performed by using a continuous series of subsequent dosage cycles each of which comprised of a 10 second dosage step (=city water at a temperature of 40° C. being sprayed onto the blocks) and a 10 second pause. To detect the dosage behavior of the two blocks, the electric conductivity of the resulting detergent solution was measured as a function of time, leading to the conductivity-time-data shown in FIG. 1.

The differences in the electric conductivities of the two blocks are related to the higher conductivity and solubility of the sodium hydroxide that is part of the domain material, compared to the electric conductivity and the solubility of the ash forming the reference block.

In the course of each dosage experiment, first the electric conductivity of the resulting detergent solutions increases with time, as the detergent concentration increases with time. Thereby, the electric conductivity of the solution form the block according to the invention increases faster and stronger than the conductivity of the solution obtained from the ash-based reference block. This faster formation of a solution of higher electric conductivity by the inventive block prototype is related to i) the higher solubility of the sodium hydroxide in water, and ii) the higher molar ionic conductivity of sodium hydroxide ($Na^+$: 50.10 $S \cdot cm^2/mol$; $OH^-$: 199.1 $S \cdot cm^2/mol$; data taken from P. W. Atkins, Physical Chemistry 5$^{th}$ ed., Oxford University press 1994), both compared to the respective properties of the ash that forms the reference block ($Na^+$: 50.10 $S \cdot cm^2/mol$; $CO_3^{2-}$: 138.6 $S \cdot cm^2/mol$; data taken from P. W. Atkins, Physical Chemistry 5$^{th}$ ed., Oxford University press 1994). Thus, the average solubility of the inventive block as well as the average electric conductivity of its solution is higher compared to the ash-based reference block, leading i) to the observed stronger increase of the electric conductivity at the beginning of the experiment for the inventive block, and ii) as well to its faster complete dissolution. Accordingly, since the dosage tests were conducted until the respective blocks were completely dissolved, the total experimental time of ca. 1.4 h for the block according to the present invention is lower than for the ash-based reference block (ca. 1.9 h).

These findings for the two blocks indicate that the inventive block can be dosed similarly to the ash-block, but shows a different time-dependent conductivity due to the sodium hydroxide content in the domain material. Despite the difference, the sodium hydroxide is dissolved with time as well.

The invention claimed is:

1. A solid block comprising a solidified material, characterized in that the solid block comprises one or more domains of prismatic or cylindrical shape extending between two parallel surfaces of the solid block from one surface to the other;

wherein the solidified powder inside the one or more domains and the solidified powder outside the one or more domains each comprises one or more chemical substances;

wherein the chemical composition of the solidified powder inside the one or more domains is different from the chemical composition of the solidified powder outside the one or more domains;

wherein the solidified powder inside the one or more domains comprises a peroxidation catalyst, and the solidified powder outside the one or more domains comprises the one or more peroxides;

wherein the solidified powder outside the one or more domains is free of the peroxidation catalyst, and the solidified powder inside the one or more domains is free of the peroxides; and wherein the peroxidation catalyst is a compound according to formula (I); or wherein the solidified powder outside the one or more domains comprises a peroxidation catalyst, and the solidified powder inside the one or more domains comprises the one or more peroxides, wherein the solidified powder inside the one or more domains is free of the peroxidation catalyst, and the solidified powder outside the one or more domains is free of the peroxides; wherein the peroxidation catalyst is a compound according to formula (I);

$$[(L_pM_q)_nX_r]Y_s \quad (I)$$

wherein each L independently is an organic ligand containing at least three nitrogen atoms and/or at least two carboxyl groups that coordinate with the metal M;

M is Mn or Fe;

each X independently is a coordinating or bridging group selected from the group consisting of $H_2O$, $OH^-$, $SH^-$, $HO_2^-$, $O^{2-}$, $O_2^{2-}$, $S^{2-}$, $F^-$, $Cl^-$, $Br^-$, $I^-$, $NO_3^-$, $NO_2$, $SO_4^{2-}$, $SO_3^{2-}$, $PO_4^{3-}$, $N_3^-$, $CN^-$, $NR_3$, $NCS^-$, RCN, $RS^-$, $RCO_2^-$, $RO^-$, and

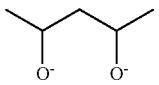

with R being hydrogen or a $C_1$ to $C_6$ alkyl group;

p is an integer from 1 to 4;

q is an integer from 1 to 2;

r is an integer from 0 to 6;

Y is a counter ion; and s is the number of counter ions.

2. The solid block according to claim 1, characterized in that the solubility in water at 25° C. of the solidified powder inside the one or more domains and the solubility in water at 25° C. of the solidified powder outside the one or more domains differ by not more than 10%.

3. The solid block according to claim 1, characterized in that the solidified powder inside the one and more domains and/or outside the one or more domains is a solidified powder or a congealed melt.

4. The solid block according to claim 1, characterized in that the solidified powder inside the one and/or more domains and/or the solidified powder outside the one and more domains comprises one or more of peroxides, peroxidation catalysts, surfactants, chelating/sequestering agents, detergent fillers or binding agents, alkalinity sources, enzymes, activating agents, defoaming agents, anti-redeposition agents, dyes, odorants, bleaching agents, and water.

5. The solid block according to claim 1, characterized in that the solidified powder inside the one and/or more domains and/or the solidified powder outside the one and more domains is free of one or more of peroxides, peroxidation catalysts, surfactants, chelating/sequestering agents, detergent fillers or binding agents, alkalinity sources, enzymes, activating agents, defoaming agents, anti-redeposition agents, dyes, odorants, bleaching agents, and water.

6. The solid block according to claim 1, characterized in that the one or more domains make up between 10% and 50% of the volume of the solid block.

7. The solid block according to claim 1, characterized in that the perimeter of the solid block measured between two parallel surfaces is between 0.2 to 0.5 m.

8. The solid block according to claim 1, characterized in that the weight of the solid block is more than 0.5 kg.

9. The solid block according to claim 1, characterized in that the solidified powder inside the one or more domains comprises the one or more peroxides, the solidified powder outside the one or more domains comprises the peroxidation catalyst, and the solidified powder outside the one or more domains is free of the peroxides.

10. A method for producing a solid block according to claim 1, comprising the following steps:

a. providing a first powder comprising one or more chemical substances,
b. filling the first powder in a mold having prismatic or cylindrical shape,
c. solidifying the powder to a solid block of prismatic or cylindrical shape,
d. optionally repeating steps a. to c.,
e. placing one or more solid blocks of prismatic or cylindrical shape in a second mold of larger volume than the volume of the one or more solid blocks of prismatic or cylindrical shape,
f. filling the free volume of the second mold with a second powder comprising one or more chemical substances, the second powder having a different chemical composition from the first powder of step a.,
g. solidifying the powder of step f. to obtain a solid block.

11. A method for producing a solid block according to claim 1, comprising the following steps:

a. providing a first powder comprising one or more chemical substances,
b. melting the powder,
c. filling the melted powder in a first mold having one or more inserts of prismatic or cylindrical shape,
d. solidifying the melted powder,
e. removing the one or more inserts to leave one or more holes,
f. providing a second powder comprising one or more chemical substances, the second powder having a different chemical composition from the first powder of step a.,
g. melting the second powder,
h. optionally repeating steps f. to g.,
i. filling the melted second powder in the one or more holes,
j. solidifying the melted second powder in the one or more holes to obtain a solid block.

12. A method for producing a solid block according to claim 1, comprising the following steps:

a. providing a first powder comprising one or more chemical substances,
b. melting the first powder
c. filling the melted first powder in a mold,
d. solidifying the melted first powder,
e. drilling one or more holes of prismatic or cylindrical shape into the melted first powder,
f. providing a second powder comprising one or more chemical substances, the second powder having a different chemical composition from the first powder of step a.,
g. melting the second powder,
h. optionally repeating steps f. to g.,
i. filling the melted second powder in the one or more holes,
j. solidifying the melted second powder in the one or more holes to obtain a solid block.

13. Use of a solid block according to claim 1 as detergent in warewashing applications.

14. The use according to claim 13, characterized in that the solid block is inserted in industrial warewashing machines.

15. The solid block according to claim 1, characterized in that the one or more domains make up between about 25% and about 35% of the volume of the solid block.

16. The solid block according to claim 1, characterized in that the perimeter of the solid block measured between two parallel surfaces is between about 0.2 m to about 0.4 m.

17. The solid block according to claim 1, characterized in that the perimeter of the solid block measured between two parallel surfaces is about 0.3 m.

18. The solid block according to claim 1, characterized in that the weight of the solid block is more than about 0.5 kg.

19. The solid block according to claim 1, characterized in that the weight of the solid block is more than about 1 kg.

* * * * *